US006202742B1

(12) United States Patent
Echols

(10) Patent No.: US 6,202,742 B1
(45) Date of Patent: Mar. 20, 2001

(54) PACK-OFF DEVICE FOR USE IN A WELLBORE HAVING A PACKER ASSEMBLY LOCATED THEREIN

(75) Inventor: Ralph H. Echols, Dallas, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/185,407

(22) Filed: Nov. 3, 1998

(51) Int. Cl.[7] ..... E21B 33/122; E21B 34/14; E21B 43/04

(52) U.S. Cl. ..... 166/51; 166/158; 166/191; 166/278; 166/332.4

(58) Field of Search ..... 166/51, 115, 116, 166/127, 157, 158, 191, 278, 313, 332.4

(56) References Cited

U.S. PATENT DOCUMENTS 3,421,586 * 1/1969 Solum ..... 166/51
3,952,804 * 4/1976 Smyrl ..... 166/51 X
4,253,522 * 3/1981 Setterberg, Jr. ..... 166/51 X
4,606,408 * 8/1986 Zunkel et al. ..... 166/191 X
4,995,456 * 2/1991 Cornette et al. ..... 166/51
5,332,045 * 7/1994 Ross et al. ..... 166/194 X
5,609,204 * 3/1997 Rebardi et al. ..... 166/51
5,842,528 * 12/1998 Johnson et al. ..... 166/278 X
5,921,318 * 7/1999 Ross ..... 166/51 X

* cited by examiner

*Primary Examiner*—George Suchfield
(74) *Attorney, Agent, or Firm*—Paul I. Herman; Charles W. Gaines

(57) ABSTRACT

The present invention provides a gravel pack assembly for use in a wellbore having a packer positioned therein with a minimum inside diameter and a primary packing seal. In one embodiment, the gravel pack assembly comprises a pack-off conduit that is coupable to the packer. The pack-off conduit has a maximum outer diameter that is sufficient to prevent the pack-off conduit from traversing the minimum inside diameter of the packer. The gravel pack assembly further includes a seal positioned about an inside diameter of the pack-off conduit. The seal is engageable with an outer surface of a tool that is passable through the pack-off conduit to inhibit fluid flow between the seal and the tool, uphole from the primary packing seal. The primary packer seal is typically near the uphole end of the packer and is the seal that isolates the downhole zones from the pressure exerted by the fluid uphole from the primary packer seal.

75 Claims, 10 Drawing Sheets

PACK-OFF DEVICE FOR USE IN A WELLBORE HAVING A PACKER ASSEMBLY LOCATED THEREIN

TECHNICAL FIELD OF THE INVENTION

The present invention is directed, in general, to a well completion assembly, and more specifically to a gravel pack assembly for gravel packing a zone in a wellbore.

BACKGROUND OF THE INVENTION

Today, for matters of economics, there is more and more emphasis on increasing well production from a single well bore. Therefore, multi-zone well completions have become increasingly popular where geological strata permit. However, sand production even in single zone wells from unconsolidated formations continues to present problems in well production due to migration of loose sands into the wellbore as the formation deteriorates under the pressure and flow of fluids therethrough. The sand particles may clog the flow passages and can seriously erode the equipment. In some instances the clogging of the production system can lead to a complete cessation of oil flow. In short, every year the oil industry spends millions of dollars correcting problems caused by sand production and incurs reduced revenue from restricted production rates.

One method of limiting the damage of sand fines is by the introducing a gravel pack about the exterior surface of production screens placed in the well adjacent to the producing formation. The screens are installed during the completion stage of well drilling when the production equipment is put in place in the well bore. The screens are designed to prevent the flow of sand fines into the production tubing along with the produced fluids. Conventionally, the screens comprise one or more wrapped wire well screens that are subsequently packed with sand, gravel or epoxy coated gravel.

The traditional way of preventing fines from clogging the production screens is a process called packing-off. Packing-off involves isolating a production zone of a well and pumping a slurry of water, gravel, and sometimes a gel into the zone between the well casing and the production screens. The "gravel" is sand of a size chosen to be trapped on the outer surface of the screens. Once packed, the slurry or proppant may also be used under pressure to fracture the oil producing formation to effect more efficient production from the well. During packing, fluid pressure is used to cause the particulate part of the slurry to form a permeable mass around the screen and within the casing, sometimes extending into the production zone. The water is forced from the slurry through the screens and back up the well by the packing pressure, leaving the particulate behind. Because of the pressure, this permeable mass conforms to the shape of the interstitial void and forms a filter that will act on the well production. As a consequence, sand fines are trapped in the permeable mass, rather than entering the production tubing and causing problems in the production equipment.

The actual procedure of packing-off is begun with the assembly of a packer setting work string. The major parts of the work string are: a packer setting tool, a packer setting assembly, a packer and, in a multi-zone well, one or more of each of the following: isolation packers, closing sleeves, and production screens. In the case of multi-zone wells, this work string may be hundreds of feet long. The bottommost packer is usually a sump packer and performs the function of inhibiting fluid flow from within the casing into the geologic structure at the end of the well. Packers above the sump packer are termed isolation packers. They generally serve to create production zones between two isolation packers. In multi-zone wells, each zone is bounded above and below by a packer, which inhibits the packing fluid flow within the casing into adjacent producing or non-producing zones. Each of the packers is set in place by hydraulic pressure or mechanical motion that expands flexible elements against the inside surface of the casing. The elements are held in their compressed state by internal locking slips that prevent the elements from relaxing.

Because geological strata capable of producing oil and gas do not occur at regular vertical intervals, the location of the isolation packers must accommodate the locations of the production zones. Therefore, the packers are assembled to the work string with the location of the production zones in mind. Just above the uppermost production zone, a primary packer is inserted in the casing to isolate the fluid head above the production zones from the production zones. This fluid head creates an overburden of pressure above the packer assembly for well control purposes. However, it is undesirable for that fluid to be directly admitted into the producing formation because it can cause damage to the formation. Also, the chemicals in the fluid are expensive and they may be recovered if they are not flushed into the formation. This uppermost packer is equipped with bi-directional metal "slips" that are retracted during work string insertion, and are extended by hydraulic pressure exerted through a packer installation tool. When extended, the slips bite into the inner casing wall to securely hold the packer and production string in place against well pressures.

Once the packers are positioned and set in the well casing, the tool string is removed and a pack-off tool string is inserted into the well. Pack-off is accomplished by vertically positioning the pack-off assembly so as to introduce the slurry into each zone, usually from the lowermost zone progressively to the uppermost zone. Conventionally, this requires one tool trip per zone to gravel pack the zone and one to complete the zone. Gravel packing and completing requires two tool string trips per zone. Thus, a three-zone well would require six tool string trips a very time and labor intensive process.

During the packing-off process the fluid integrity of the zone being packed off must be assured, preventing fluid from flowing into adjacent producing or non-producing zones. While the packers seal against the inside of the casing, the seal must be completed between the tool string and the inner diameter of the packer. This is traditionally achieved by using o-ring seals on the outer diameter of the tool mandrel, sealing against the honed inner diameter of the packers that are fixed in the well casing. In a single zone completion this is not a major problem, as the distance between the packer and the screen is easily determined. In multi-zone completions, however, because of the irregular distances between production zones, sealing the zones becomes a problem. One skilled in the art will recognize that the location of the zones dictates the position of the packers. In order to accomplish the sealing as the work string is pulled progressively up the well to pack-off each zone, seals would have to be installed every one to two feet of mandrel length in order to align with the irregular location of the packers. This quickly becomes impractical when the tool string length is several hundred feet long or extremely expensive as the number of seals increases. Although the seals themselves are a significant cost, the machining costs of providing seal recesses at this spacing is significantly greater, thus increasing the cost of the tool string. Before the well is placed into production, the pack-off work string is retrieved to the surface, and replaced with a production string. The packers remain in the casing, to isolate the production zones.

Completion structures of the type disclosed in U.S. Pat. Nos. 5,332,045 and 5,180,016, which are incorporated herein by reference, are often used in gravel pack well bores. These completion structures are generally comprised of several different completion apparatus that are coupled together and work in concert to perform various completion and testing operations within the well bore. In one such completion structure, the pack-off assembly is located below the uppermost (primary) packer of the well when the pack-off work string is in the well. With relatively large well bores, this does not present a problem since the inner diameter of the packer is large enough to allow the pack-off assembly and work string to be withdrawn through the packer. However, with smaller well bores, it quickly becomes impractical to engineer the complexity of the pack-off assembly to a size small enough to be withdrawn through a packer with an inner diameter of five inches or less.

After completing the gravel pack, a reversing of the circulation in the pack-off work string removes any gravel-laden slurry from the work string. When the circulation is reversed, clean fluid is pumped down the path previously used for the returning proppant, and thus the remaining gravel-laden slurry is forced back up the path previously used to deliver the slurry to the packing zone.

An extremely important factor in achieving the gravel pack of the production zones of an oil or gas well is the ability to achieve seals throughout the system to prevent transmission of fluids to areas where they are neither required nor desired. With all of the moving parts associated with aligning gravel pack ports, supply streams, return flow streams, the gravel pack work string must be moved up and down in the well bore to numerous locations. During these movements, and certainly when the tool string is in place to accomplish a function, the various zones of the well must be isolated from one another.

One such system is described in U.S. Pat. No. 4,606,408 to Zunkel et al., commonly assigned to the present invention. Zunkel et al teaches gravel packing of multi-zone wells, however, the gravel pack assembly is located below the primary packer and essentially uses inverted cup packers to maintain zone integrity. Therefore, the complexity of the system and its location makes it impractical for well bores of less than five inches for reasons previously stated.

Therefore, what is needed in the art is an oil and gas well gravel packing system that permits packing of multiple production zones for use in well bores having packers with smaller inside diameters and a primary packer seal.

SUMMARY OF THE INVENTION

To address the above-discussed deficiencies of the prior art, the present invention provides, in one embodiment, a gravel pack assembly for a wellbore having a packer located therein with a minimum inside diameter and a primary packing seal. In one embodiment, the gravel pack assembly comprises a pack-off conduit that is coupleable to the packer. Unlike certain prior art devices, the pack-off conduit has a maximum outer diameter that is sufficient to prevent the pack-off conduit from traversing the minimum inside diameter of the packer. The gravel pack assembly further includes a seal positioned about an inside diameter of the pack-off conduit. The seal is engageable with an outer surface of a tool that is passable through the pack-off conduit to inhibit fluid flow between the seal and the tool, uphole from the primary packing seal. The primary packer seal is typically located near the uphole end of the packer, and when deployed, it isolates the downhole zones from the pressure exerted by the fluid uphole from the primary packer seal.

Thus in a broad scope, the present invention provides a gravel pack assembly having a pack-off conduit that provides a seal between the inside diameter of the pack-off conduit and the tool, uphole from the primary packing seal.

In another embodiment, the pack-off conduit is retrievable and includes a latch mechanism configured to removably latch the gravel pack assembly to an up-hole end of the packer. As such, the pack-off conduit can easily be retrieved without the need of retrieving the packer or pulling the pack-off conduit through the packer, thereby providing a gravel pack assembly that can be used in smaller wellbores. In one particular aspect of the present invention, the latch mechanism is a threaded collet. However, those who are skilled in the art will recognize that other latch mechanisms may also be used in the present invention.

The seal used to inhibit fluid flow between the seal and the tool may include those typically used in oil and gas exploration technology. For example, the seal may be an O-ring type of seal. More specifically, the O-ring may be a metal ring having rubber thereon. In a particular advantageous embodiment, the metal ring may be threadedly retained within a groove formed in an interior side wall of the pack-off conduit. In another aspect of the present invention, the seal may comprise a plurality of seals spatially separated along a length of the pack-off conduit.

In one embodiment, the tool is a wash pipe assembly that is removably coupled to the pack-off conduit. The wash pipe assembly has an outer diameter less than an inner diameter of the pack-off conduit such that the wash pipe assembly is passable through the pack-off conduit. The tool or wash pipe assembly is preferably removably coupled to the pack-off conduit by a shear pin, which allows the tool or wash pipe assembly to be disconnected from the pack-off conduit and used as a work string. In one particular aspect of this invention, the wash pipe assembly includes an inner wash pipe and an outer wash pipe. Both the outer and inner wash pipes may include check ball valves, which operate to divert fluid flow during a gravel pack operation. In certain other embodiments, the inner wash pipe may also include a gravel pack cross over conduit. In those embodiments, where the outer wash pipe is present, the seal that is positioned within the pack-off conduit is configured or designed to engage an outer surface of the outer wash pipe to inhibit fluid flow between the seal and the outer wash pipe.

In another embodiment, the tool includes a circulation port, which, in preferred embodiments, is located above the primary packer. In yet other embodiments, the tool further includes a gravel pack port, which allows for packing a plurality of zones within a given wellbore. In a further embodiment, the tool includes a plurality of seals coupled to and positioned along a length of the tool. These seals are engageable against an interior wall of the packer to inhibit fluid flow between the seals and the packer's interior wall.

In yet another embodiment, the tool includes a shifting profile coupled to the tool that is engageable with a closing sleeve that is movably coupled to the packer assembly. As explained below, it is this shifting tool that opens and closes the circulation ports within the packer assembly to divert fluid flow in the desired direction for gravel packing operations.

Another aspect of the present invention provides a zone (e.g., geological formation) isolation assembly, comprising:

(1) a packer assembly positionable within the wellbore that has a minimum inside diameter and a primary packing seal; (2) a pack-off conduit that is coupleable to an uphole end of the packer assembly and that has a maximum outer diameter sufficient to prevent the pack-off conduit from traversing the minimum inside diameter of the packer assembly; (3) a tool passable through the pack-off conduit; and (4) a seal that is located about an inside diameter of the pack-off conduit and that is engageable with an outer surface of the tool to inhibit fluid flow between the seal and the tool, uphole from the primary packing seal. Preferably, the packer assembly has an inner diameter of five inches or less, which makes it particularly well suited for gravel pack operations that are conducted in smaller wellbores.

In another embodiment, the pack-off conduit is retrievable and includes a latch mechanism configured to removably latch it to an up-hole end of the packer. Preferably, the latch mechanism is a threaded collet. As such, the pack-off conduit can easily be retrieved without the need to retrieve the packer or pull the pack-off conduit through the packer, thereby providing a zone isolation assembly that can be used in smaller wellbores.

As with the other above-discussed embodiment, the seal used to inhibit fluid flow between the seal and the tool may include those typically used in oil and gas exploration technology. For example, the seal may be an O-ring type of seal. More specifically, the O-ring may be a metal ring having rubber thereon. In a particularly advantageous embodiment, the metal ring may be threadedly retained within a groove formed in an interior side wall of the pack-off conduit. In another aspect of the present invention, the seal may comprise a plurality of seals spatially separated along a length of the pack-off conduit.

In one aspect of this embodiment, the tool is a wash pipe assembly that is removably coupled to the pack-off conduit. The wash pipe assembly has an outer diameter less than an inner diameter of the pack-off conduit such that the wash pipe assembly can pass through the pack-off conduit. The tool or wash pipe assembly is preferably removably coupled to the pack-off conduit by a shear pin, which allows the tool or wash pipe assembly to be disconnected from the pack-off conduit and used as a work string. The wash pipe assembly may include an inner wash pipe and an outer wash pipe; both of which may include check ball valves, which operate to divert fluid flow during a gravel pack operation. In certain other embodiments, the inner wash pipe may also include a gravel pack cross over conduit. In those embodiments, where the outer wash pipe is present, the seal that is positioned within the pack-off conduit is configured or designed to engage an outer surface of the outer wash pipe to inhibit fluid flow between the seal and the outer wash pipe.

In another embodiment, the tool includes a circulation port, which, in preferred embodiments, is located above the primary packer. In yet other embodiments, the tool further includes a gravel pack port that allows for gravel packing a plurality of zones within a given wellbore. In another embodiment, the tool includes a plurality of seals coupled to and positioned along a length of the tool. These seals are engageable against an interior wall of the packer to inhibit fluid flow between the seals and the packer's interior wall.

In yet another embodiment, the tool includes a shifting profile coupled to the tool that is engageable with a closing sleeve movably coupled to the packer. As explained below, it is this shifting tool that opens and closes the circulation ports within the packer to divert fluid flow in the desired direction for gravel packing operations.

In one particular aspect of this embodiment, the packer assembly includes a primary packer seal adjacent an uphole end of the packer assembly. Moreover, the packer assembly may include an isolation packer seal positioned downhole from the primary packer seal. In preferred embodiments, the packer assembly includes a plurality of spatially separated isolation packer seals positioned downhole from the primary packer seal. The packer assembly may also include circulation ports for controlling fluid circulation during gravel pack operations, as well as other completion operations. In such embodiments, the packer assembly may further include a closing sleeve coupled to the packer assembly adjacent the circulation port. The closing sleeve is movable with respect to the circulation port between an open position and a closed position. Preferably, the packer assembly includes a plurality of such circulation ports, with each of the circulation ports having a closing sleeve adjacent each of the circulation ports.

In yet other embodiments, the packer assembly may include a gravel pack screen that is coupled to and downhole from the packer assembly. Preferably, the packer assembly includes a plurality of spatially separated gravel pack screens coupled to and downhole from the packer assembly.

In yet another aspect of the present invention, there is provided a well completion system, comprising: (1) a packer assembly positionable within the wellbore and having a minimum inside diameter and a primary packing seal; (2) a packer setting assembly removably coupleable to the packer assembly; (3) a pack-off conduit coupleable to an uphole end of the packer assembly and having a maximum outer diameter sufficient to prevent the pack-off conduit from traversing the minimum inside diameter of the packer assembly; (4) a tool passable through the pack-off conduit; and (5) a seal located about an inside diameter of the pack-off conduit and engageable with an outer surface of the tool to inhibit fluid flow between the seal and the tool, uphole from the primary packing seal.

In one embodiment, the pack-off conduit is retrievable and includes a latch mechanism configured to removably latch the gravel pack assembly to an up-hole end of the packer. Preferably, the latch mechanism is a threaded collet. As such, the pack-off conduit can easily be retrieved without the need of retrieving the packer or pulling the pack-off conduit through the packer, thereby providing a gravel pack assembly that can be used in smaller wellbores.

The seal used to inhibit fluid flow between the seal and the tool may include those typically used in oil and gas exploration technology. For example, the seal may be an O-ring type of seal. More specifically, the O-ring may be a metal ring having rubber thereon. In a particular advantageous embodiment, the metal ring may be threadedly retained within a groove formed in an interior side wall of the pack-off conduit. In another aspect of the present invention, the seal may comprise a plurality of seals spatially separated along a length of the pack-off conduit.

In one embodiment, the tool is a wash pipe assembly that is removably coupled to the pack-off conduit. The wash pipe assembly has an outer diameter less than an inner diameter of the pack-off conduit such that the wash pipe assembly can pass through the pack-off conduit. The tool or wash pipe assembly is preferably removably coupled to the pack-off conduit by a shear pin, which allows the tool or wash pipe assembly to be disconnected from the pack-off conduit and used as a work string. In one particular aspect of this embodiment, the wash pipe assembly includes an inner wash pipe and an outer wash pipe. Both the outer and inner wash pipes may include check ball valves, which operate to divert fluid flow during a gravel pack operation. In certain other embodiments, the inner wash pipe may also include a gravel pack cross over conduit. In those embodiments, where the outer wash pipe is present, the seal that is positioned within the pack-off conduit is configured or designed to engage an outer surface of the outer wash pipe to inhibit fluid flow between the seal and the outer wash pipe.

In another embodiment, the tool includes a circulation port, which, in preferred embodiments, is positioned above the primary packer. In yet other embodiments, the tool further includes a gravel pack port, which allows for packing a plurality of zones within a given wellbore. In a further embodiment, the tool includes a plurality of seals coupled to and positioned along a length of the tool. These seals are engageable against an interior wall of the packer to inhibit fluid flow between the seals and the packer's interior wall.

In yet another embodiment, the tool includes a shifting profile coupled to the tool that is engageable with a closing sleeve movably coupled to the packer. As explained below, it is this shifting tool that opens and closes the circulation ports within the packer to divert fluid flow in the desired direction for gravel packing operations.

In one particular aspect of this embodiment, the packer assembly includes a primary packer seal adjacent an uphole end of the packer assembly. Moreover, the packer assembly may include an isolation packer seal positioned downhole from the primary packer seal. In preferred embodiments, the packer assembly includes a plurality of spatially separated isolation packer seals downhole from the primary packer seal. The packer assembly may also include circulation ports for controlling fluid circulation during gravel pack operations, as well as other completion operations. In such embodiments, the packer assembly may further include a closing sleeve coupled to the packer assembly adjacent the circulation port. The closing sleeve is movable with respect to the circulation port between an open position and a closed position. Preferably, the packer assembly includes a plurality of such circulation ports, with each of the circulation ports having a closing sleeve located adjacent each of the circulation ports.

In yet other embodiments, the packer assembly may include a gravel pack screen that is coupled to and downhole from the packer assembly. In another aspect of this embodiment, the packer assembly includes a plurality of spatially separated gravel pack screens coupled to and downhole from the packer assembly.

In another aspect of the present invention, there is provided a method of gravel packing a zone in a wellbore, comprising the steps of: (1) setting a packer in said wellbore to isolate a zone from an annular fluid above the packer that has a minimum inside diameter and a primary packing seal; (2) coupling a pack-off conduit of a gravel pack assembly to an uphole end of said packer wherein the pack-off conduit has a maximum outer diameter sufficient to prevent the pack-off conduit from traversing the minimum inside diameter; (3) forming a seal between an inner diameter of said pack-off conduit and a tool passing through the pack-off conduit to inhibit a fluid flow between the seal and the tool, uphole from the primary packing seal; (4) opening with a tool, a circulation port in the packer that is located adjacent the zone; (5) moving a gravel pack port adjacent to the circulation port and flowing a packing fluid through the gravel pack port and the circulation port and into the zone and packing the zone with the packing fluid; (6) forming a seal between the gravel pack port and the circulation port; and (7) reversing a fluid flow within the tool to move the fluid uphole from the zone.

The foregoing has outlined, rather broadly, preferred and alternative features of the present invention so that those who are skilled in the art may better understand the detailed description of the invention that follows. Additional features of the invention that are described hereinafter form the subject of the claims of the invention. Those who are skilled in the art should appreciate that they can readily use the disclosed conception and specific embodiment as a basis for designing or modifying other structures for carrying out the same purposes of the present invention. Those who are skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
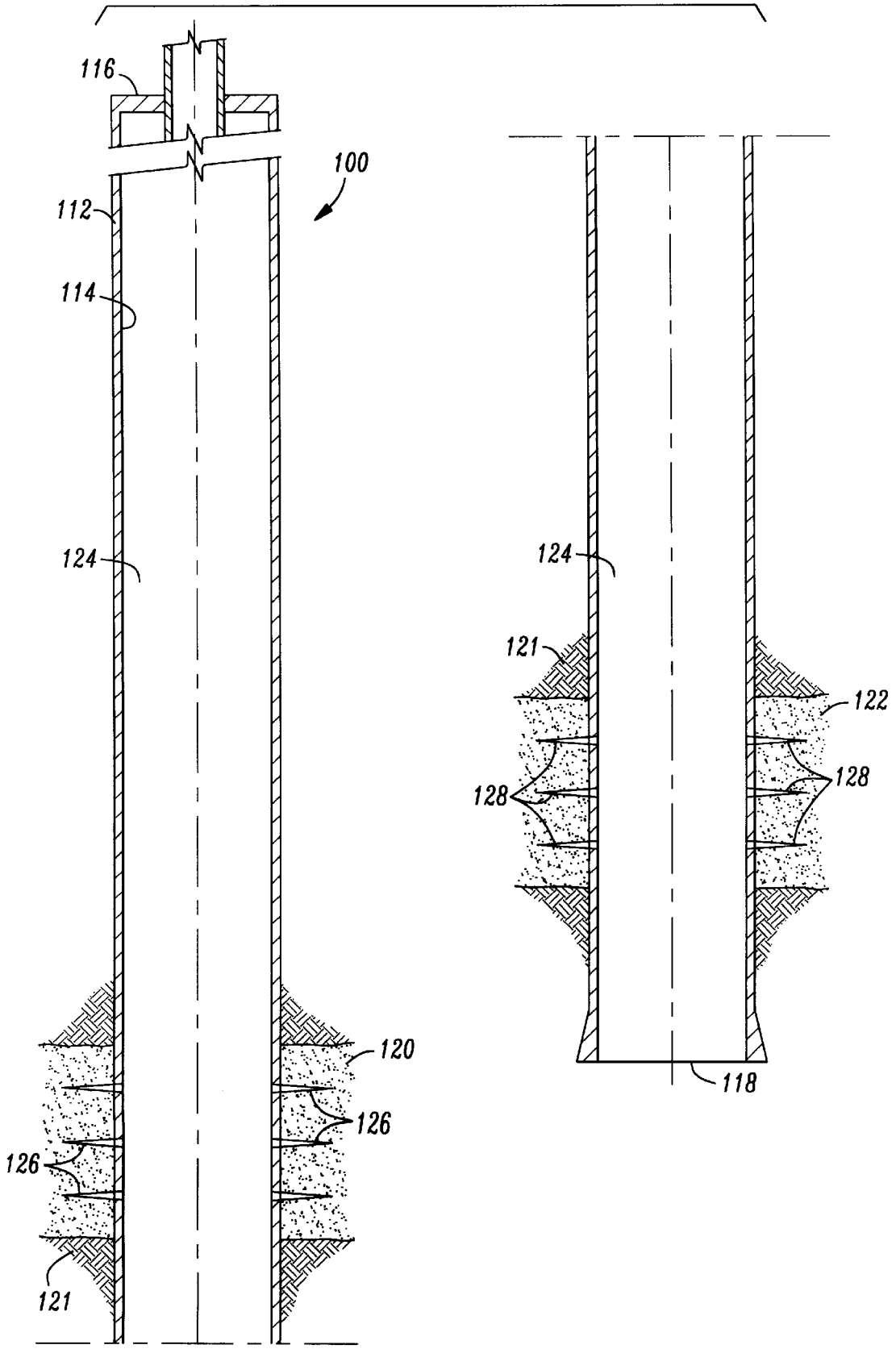
FIG. 1 illustrates a schematic elevational view of an exemplary multi-zone oil well.

Referring initially to FIG. 1, illustrated is a schematic elevational view of an exemplary multi-zone oil well. A well, generally designated by the numeral 100, is defined by a well casing 112 and has a well bore 114, an uphole end 116, and a downhole end 118. The well casing 112 extends from the uphole end 116 which may also be referred to as a surface location to the downhole end 118 which defines the bottom of the well. For the purposes of this discussion, the well casing 112 intersects first and second subsurface oil and/or gas producing formations 120 and 122, respectively, which are to be gravel-packed. Producing formations 120 and 122 are separated by a non-producing formation 121. The producing formations 120, 122 may also be referred to as first and second production zones, respectively. One skilled in the art will recognize that the gravel packing system being described is also readily applicable to a single zone or to more than two zones.

The first formation 120 is communicated with a well cavity 124 by a plurality of perforations 126 which extend through the well casing 112 and into the subsurface formation 120. Similarly, a plurality of perforations 128 communicate the well cavity 124 with the second formation 122.

Figure 2A:
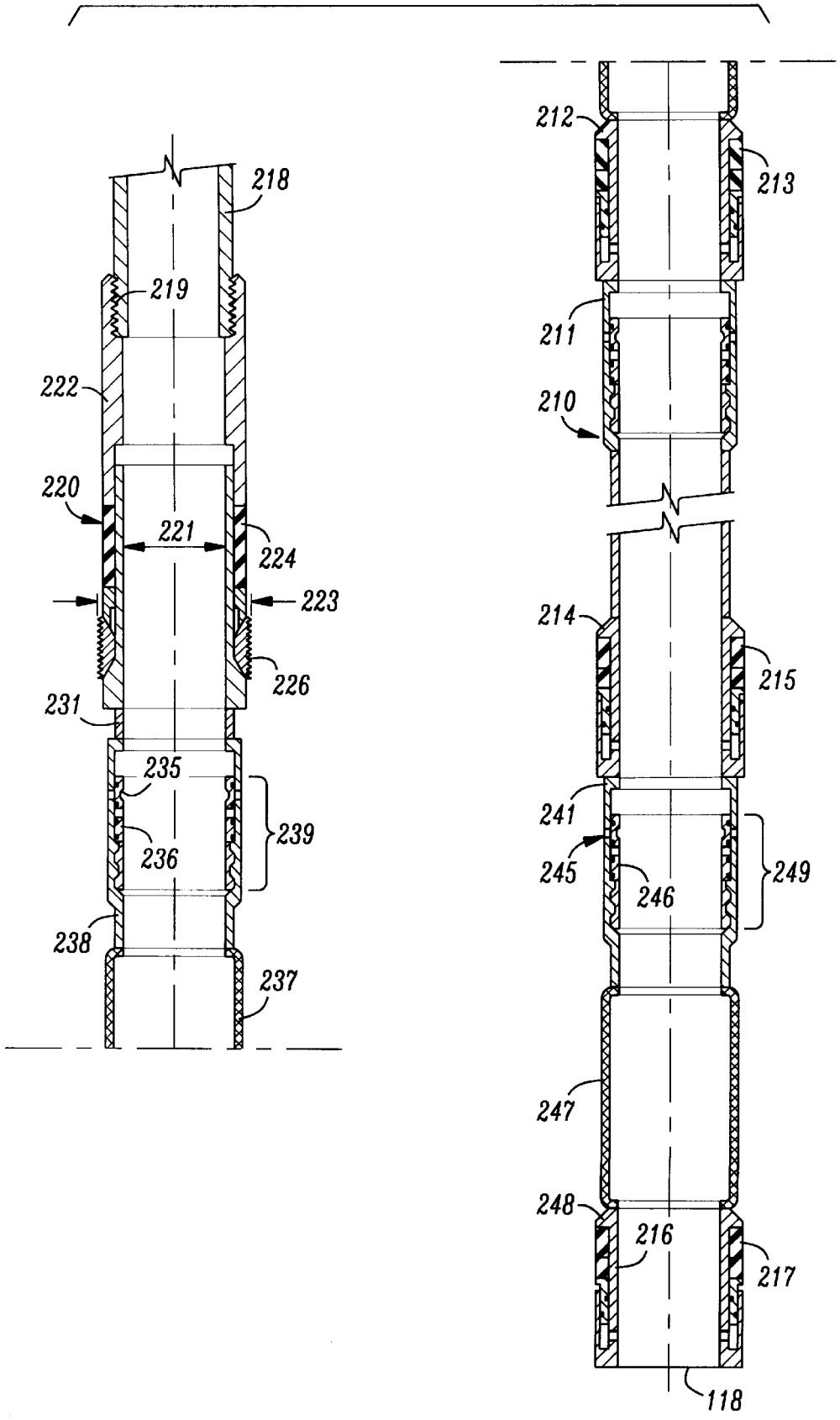
FIG. 2A illustrates a schematic elevational view of one embodiment of a conventional packer assembly for installation in the well of FIG. 1.

Before the well can be put into production, a production string must be installed in the well casing and the production zones must be gravel packed. Referring now to FIG. 2A with continued reference to FIG. 1, illustrated is a schematic elevational view of one embodiment of a conventional packer assembly for installation in the well. The packer assembly 210, which may also serve as a production string, comprises a plurality of sections of production tubing 211, a primary packing assembly 220, a plurality of isolation packers 212, 214, and a sump packer 216. The primary packing assembly 220 may also be referred to as the primary packer. One skilled in the art will recognize that a sump packer 216 at the well bottom 118 may not be required in those wells which are sufficiently consolidated at the well bottom 118. Generally, the locations of the packers 220, 212, 214, 216 are chosen on the packer assembly 210 so that each producing zone 120, 122 is isolated with one packer above and one packer below the producing zone. The packer assembly 210 is positionable within the well bore 114 to assure the location of the packers as described. Therefore, the region between any two adjacent packers constitutes either a producing or non-producing zone. FIG. 2A illustrates a packer assembly 210 for two producing zones 120, 122 of equal thickness with an intervening non-producing zone 121. One skilled in the art will recognize that producing zones may be of unequal thicknesses and separated by non-producing zones of irregular thicknesses without affecting the scope and intent of the present invention.

The primary packer 220 comprises a packer body 222, a primary packing seal 224, and a plurality of expandable slips 226. The packer body 222 comprises a toroid having a minimum inside diameter 221 and a maximum outside diameter 223. In a preferred embodiment of the present invention, the inside diameter 221 of the packer body 222 is five inches or less. However, one skilled in the art will recognize that the present invention can be used in wells with larger diameters. The maximum outside diameter 223 of the packer body 222 is less than the inside diameter 114 of the well casing 112. The primary packing seal 224 is located radially about the circumference of the packer body 222, and the plurality of expandable slips 226 is distributed equally about the circumference of the packer body 222.

Associated with the first production zone 120 of FIG. 1 is the primary packer 220 and an isolation packer 212. The production zone 120 is positioned between and isolated by the primary packer 220 and the isolation packer 212. Likewise, associated with the second production zone 122 of FIG. 1 is another isolation packer 214 and the sump packer 216. The packers 220, 212, 214, 216 are coupled to the production tubing 211 and provide support for the production tubing 211 when installed in the well 100. The packers 220, 212, 214, 216 also provide fluid flow inhibiting bi-directional sealing elements 224, 213, 215, 217, respectively, in the annulus 124 adjacent the packers 220, 212, 214, 216.

The uppermost portion of the primary packer 220 is preferably equipped with an attachment collar 219 to which a drill pipe string 218 is connected when the well is in production. One skilled in the art will recognize that a variety of such attachment devices may be employed at this location. The attachment collar 219 on the primary packer 220 is also useful during the well completion process as will be described below.

Assembled in the packer assembly 210 between the zone isolation packers 220, 212, 214, 216 is a plurality of sets of like components, one such set corresponding to each of the subsurface production zones to be gravel-packed. Beginning at the primary packer 220, a representative set for the first production zone 120 comprises: upper production tubing 231 which mechanically engages the primary packer 220, a circulation port 235, a closing sleeve 236, a production screen 237, and lower production tubing 238 that mechanically engages the isolation packer 212. The second zone 122 has analogous upper production tubing 241 which mechanically engages the isolation packer 214, a circulation port 245, a closing sleeve 246, a production screen 247, and lower production tubing 248 that mechanically engages the sump packer 216.

The circulation port 235 and closing sleeve 236 cooperate to form a conventionally designed, first selectively openable, closing sleeve valve 239 that is connected in the packer assembly 210 below the primary packer 220 and above the first zone production screen 237. The slidable closing sleeve 236 is of conventional design and selectively engageable by a shifting profile to operate the closing sleeve valve 239. The shifting profile is described in conjunction with the gravel packing assembly 270. The closing sleeve 236 operates to open or close the circulation port 235 in the production tubing 231 to effect the desired flow of packing slurry as described below.

Likewise, a second selectively openable, closing sleeve valve 249, which is also of conventional design, is connected in the packer assembly 210 below the isolation packer 214 and above the second zone production screen 247. Similarly, the second closing sleeve valve 249 includes a selectively engageable closing sleeve 246 that is also operable by the aforementioned shifting profile. The sliding sleeve 246 operates to open or close circulation port 245 to effect the desired flow of packing slurry relative to the second production zone 122.

Figure 2B:
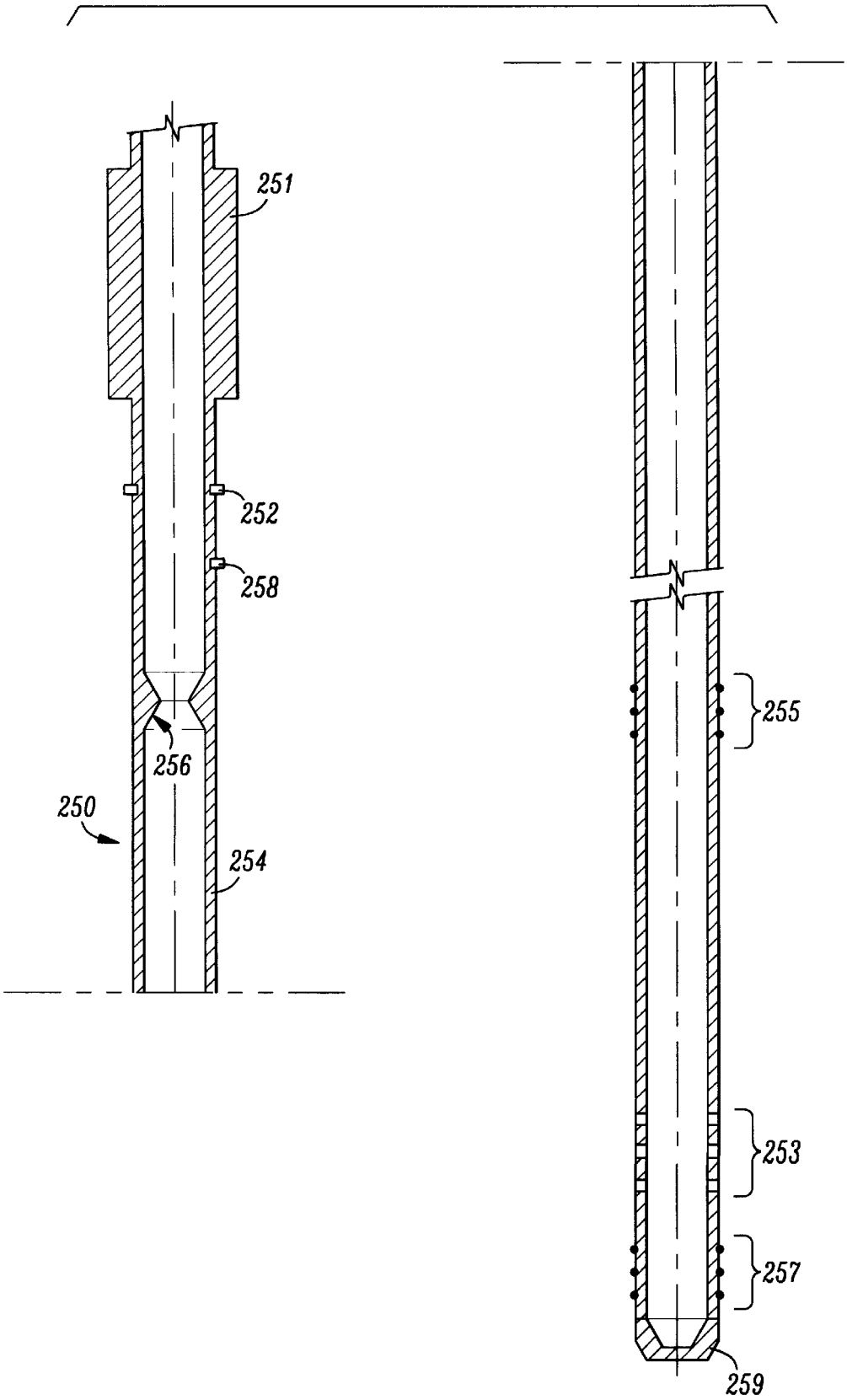
FIG. 2B illustrates a schematic elevational view of one embodiment of a packer setting assembly for use with the packer assembly of FIG. 2A.

Referring now to FIG. 2B, illustrated is a schematic elevational view of one embodiment of a packer setting assembly for use with the packer assembly of FIG. 2A. A packer setting assembly, generally designated 250, comprises a packer setting tool 251, packer setting ports 253, packer setting tubing 254, upper packer setting seals 255, lower packer setting seals 257, and a tool bottom plug 259. The packer setting tool 251 is removably coupleable to the primary packer assembly 220 through disengageable lugs 252. The packer setting tubing 254 is constructed of tubing of sufficient strength to contain hydraulic pressure which will be used to set the primary packer 220 and the isolation packers 212, 214, 216. The packer setting tubing 254 further comprises a ball valve seat 256 and a shear pin 258.

Figure 2C:
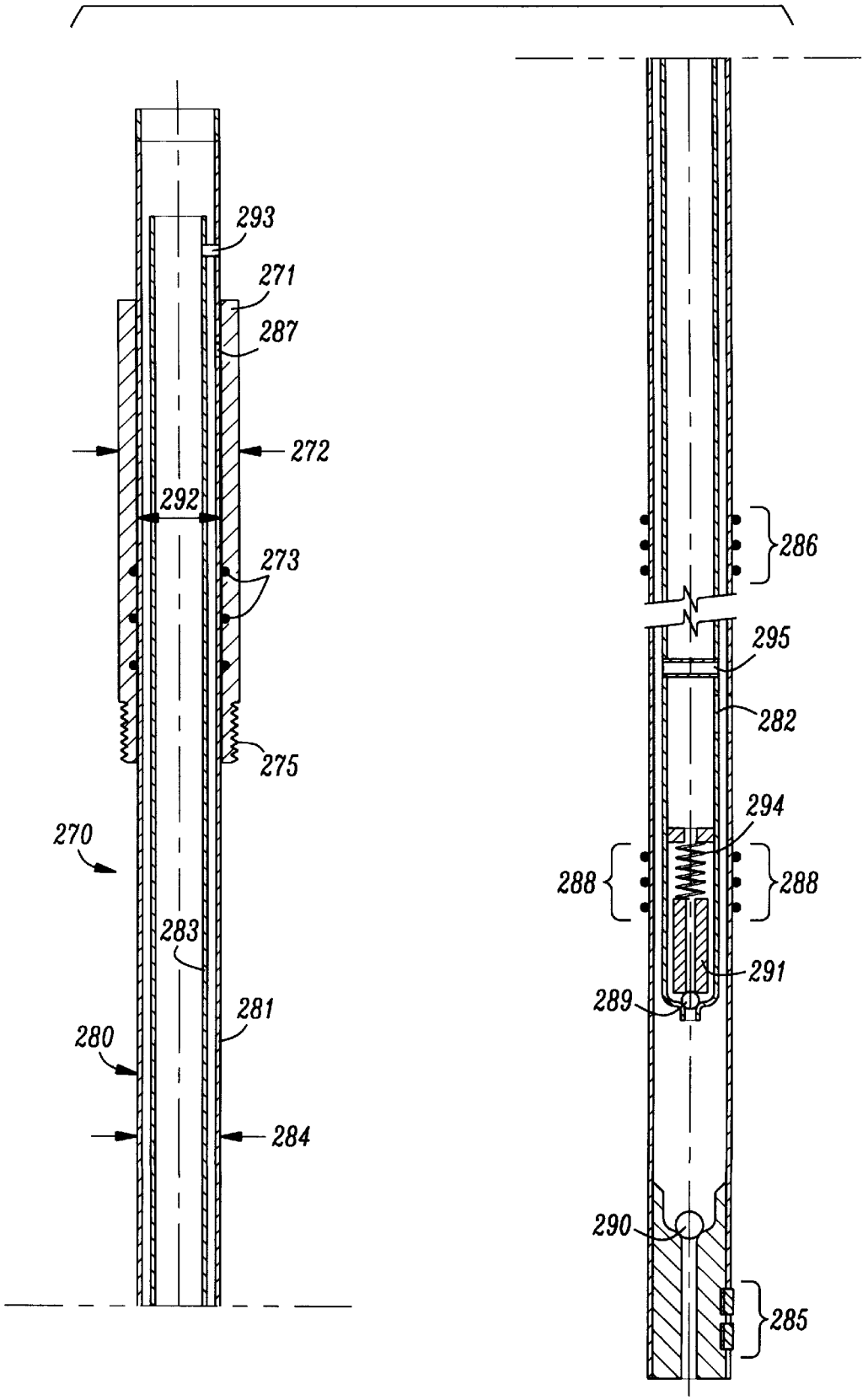
FIG. 2C illustrates a schematic elevational view of one embodiment of a gravel packing assembly for use with the packer assembly of FIG. 2A.

Referring now to FIG. 2C with continued reference to FIG. 2A, illustrated is a schematic elevational view of one embodiment of a gravel packing assembly for use with the packer assembly. Beginning at the upper end, a gravel packing assembly 270 comprises a pack-off conduit 271, a seal 273, a latch mechanism 275, and a tool 280. The pack-off conduit 271 is coupleable to the uphole end of the primary packer 220 through the latch mechanism 275. In a preferred embodiment, the latch mechanism 275 is a threaded collet 275 which engages the attachment collar 219 at the uphole end of the primary packer 220. The maximum outer diameter 272 of the pack-off conduit 271 is greater than the inside diameter 221 of the primary packer 220. Thus, the pack-off conduit 271 is prevented from passing through the primary packer 220. However, the outer diameter 284 of the tool 280 is less than the inside diameter 221 of the primary packer 220 and is also less than the inside diameter 292 of the pack-off conduit 271. Thus, the tool 280 is able to pass through both the pack-off conduit 271 and the primary packer 220. In a preferred embodiment, the tool 280 is a wash pipe assembly. The tool 280 is removably coupled to the pack-off conduit 271. In a preferred embodiment, the tool 280 comprises dual concentric wash pipes, an outer wash pipe 281 and an inner wash pipe 283. The outer wash pipe 281 and inner wash pipe 283 are mechanically joined near their upper ends by a shear pin 293 so that the inner and outer wash pipes 283, 281 move as a single unit until the pin 293 is sheared. The outer wash pipe 281 further comprises an outer wash pipe port 287 near its upper end. In a preferred embodiment the outer wash pipe 281 includes an outer wash pipe ball check valve 290 held in the closed position by gravity and the inner wash pipe 283 includes an inner wash pipe ball check valve 289 held in the closed position by a fluted member 291 and a spring 294. The inner wash pipe 283 further comprises a gravel pack cross over conduit 295.

In a preferred embodiment, the upper portion of the tool 280 is a drill pipe and has an outer diameter 284 less than the inside diameter 292 of the pack-off conduit 271. The upper portion of the tool 280, i.e., the drill pipe, also has an outer diameter 284 less than the inside diameter 221 of the packer 220. The seal 273 is positioned about an inside diameter of the pack-off conduit 271, and engages the substantially mill finish on the outer surface of the drill pipe 280, inhibiting fluid flow between the drill pipe 280 and the seal 273, as the tool 280 is moved up or down through the pack-off conduit 271. Thus, the seal 273 inhibits fluid flow when engaged against the moderately rough surface of the drill pipe 280. In a preferred embodiment, the seal is an O-ring, perhaps made of rubber, NEOPRENE®, or other suitable material. In an alternative embodiment, the O-ring is assembled as a metal ring with rubber or other suitable material thereon to inhibit fluid flow. In yet another alternative embodiment, the metal O-ring is externally threaded so as to engage matching internal threads within a groove in the inside diameter of the pack-off conduit 271. In yet another alternative embodiment, the seal 273 comprises a plurality of seals spatially separated along a length of the pack-off conduit 271. One skilled in the art will recognize that several alternative forms of the seal 273 may be readily conceived while remaining within the scope of the current invention.

The tool 280 further includes a plurality of upper gravel pack seals 286 and lower gravel pack seals 288 located about the outer surface of the tool 280 above and below the gravel pack port 282. In a preferred embodiment, the tool 280 further includes a shifting profile 285 that is coupled to the downhole end of the tool 280 and that is engageable with the closing sleeves 236, 246 of the packer assembly 210.

Figure 3A:
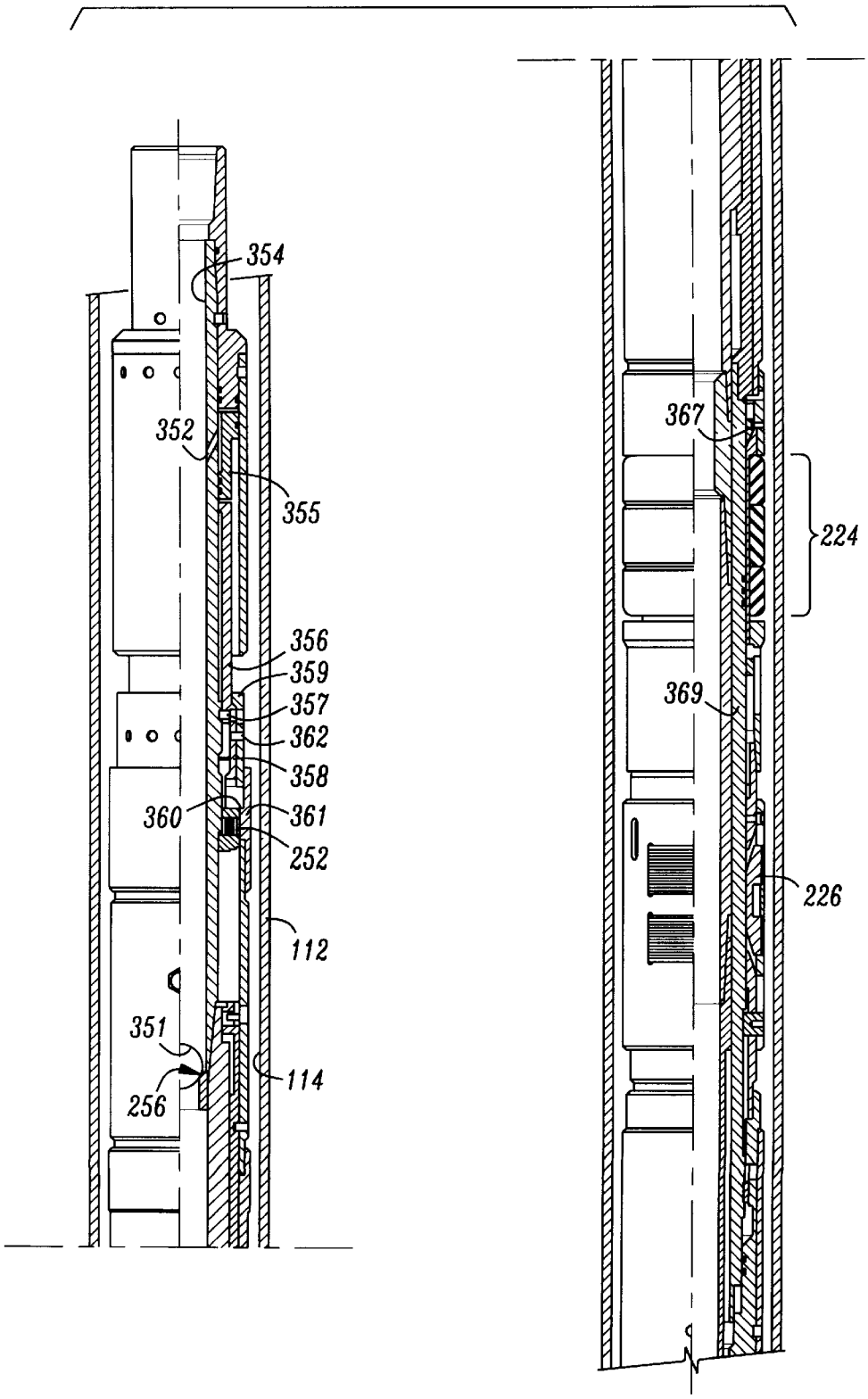
FIG. 3A illustrates a schematic elevational view of the wellbore of FIG. 1 with the packer assembly of FIG. 2A being run into the well with the packer setting assembly of FIG. 2B.

With the well 100, packer assembly 210, packer setting assembly 250, and gravel packing assembly 270 having been described above, a preferred method of their employment in a well completion system will now be discussed. Referring now to FIG. 3A, illustrated is a schematic elevational view of a portion of the wellbore of FIG. 1 with a partial sectional view of the packer assembly of FIG. 2A being run into the well with the packer setting assembly of FIG. 2B. The packer assembly 210 and the packer setting assembly 250 are removably coupled by lugs 252 extending radially from the packer setting assembly 250. The entire assembly 210, 250 is run into the well bore 114 so that the primary packer 220 is above the first production zone 120 and the isolation packer 212 is below the first production zone 120. Likewise an isolation packer 214 is located above the second production zone 122 and the sump packer 216 is below the second production zone 122. In general, the packers 220, 212, 214, 216 secure the well annulus 124 from fluid flow between adjacent zones 120, 121 and 122. The installation places the first and second production screens 237, 247 adjacent the first and second productions zones 120, 122, respectively.

The setting of the packer assembly 210 will now be briefly discussed. It should be recognized, however, that one skilled in the art is familiar with the intimate details of hydraulically-set well packers. When the packer assembly 210 is properly located vertically within the well 100, a ball 351 is dropped down the tool bore 354 to be captured at the tapered ball check valve seat 256. Hydraulic pressure is then applied through the tool bore 354 attached to the packer setting tool 251. Pressure is communicated to the primary packer 220 through a setting port 352 that communicates with an upper end of a compression piston 355 that moves downward, forcing upper piston extension 356 to shear pin 357. Further downward motion causes upper piston extension 356 to contact lower piston extension 358. Lower piston extension 358 and inner packer setting collar 359 move downward together until inner packer setting collar 359 contacts lug release shoulder 360, releasing lugs 252. Continued downward motion shears pin 362 and transfers downward force to outer packer setting collar 361. Further downward motion of outer packer setting collar 361 causes longitudinal compression and radial expansion of the sealing elements 224. The longitudinal compression further causes the retractable slips 226 to extend and compresses the packer elements 224 so that the slips 226 and the packer elements 224 engage the inner wall 114 of the well casing 112. The packer elements 224 and retractable slips 226 are prevented from retracting by internal slips 367 which engage the surface of the packer mandrel 369. When the primary packer 220 has been set, the ball 351 is reversed out of the tool bore 354, leaving an open circulation path from the surface 116 to the bottom plug 259. The packer setting tool 251 automatically disconnects from the primary packer 220 when the lugs 252 retract during the setting operation.

Figure 3B:
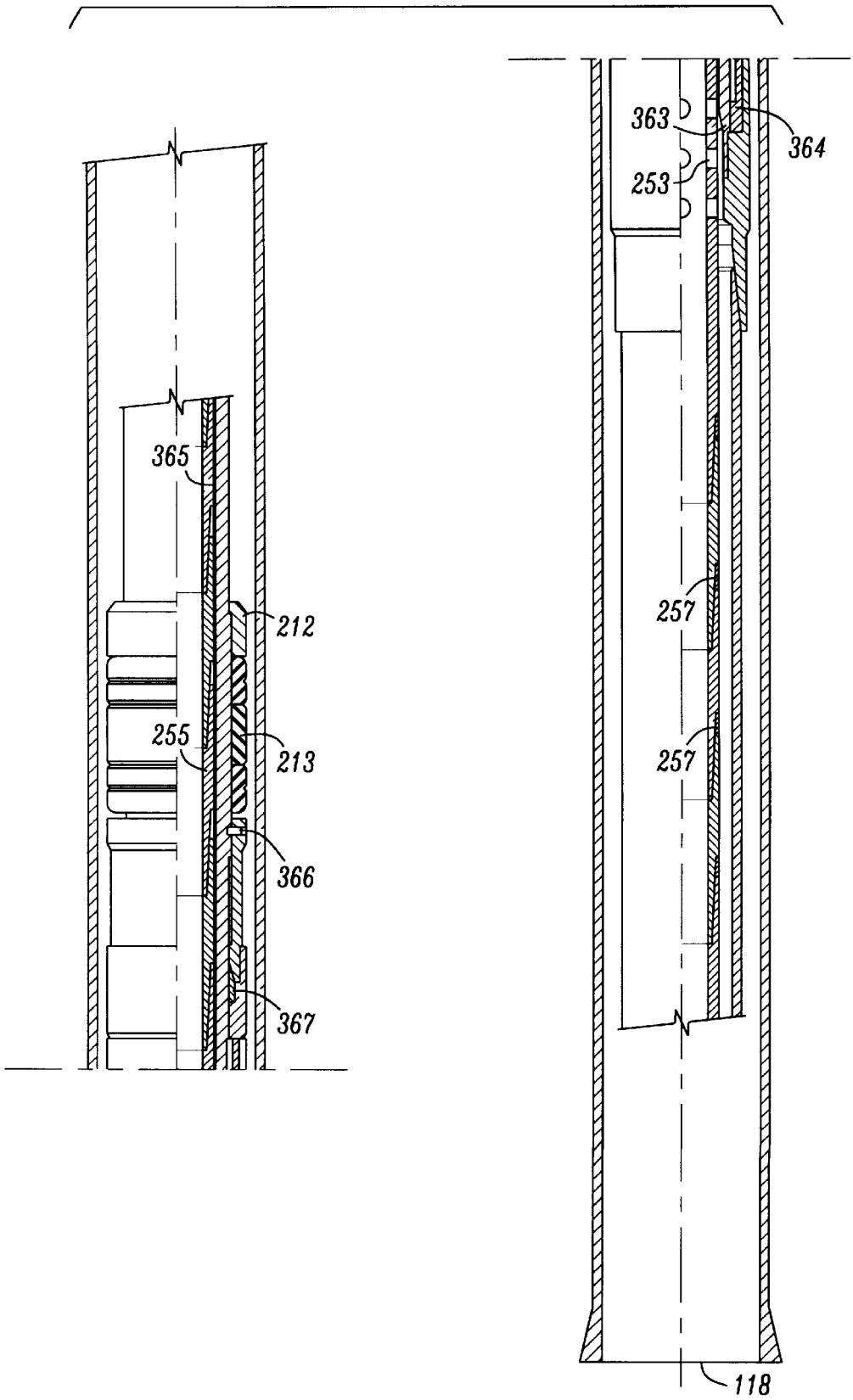
FIG. 3B illustrates a schematic elevational view of the installation of FIG. 3A with the packer setting ports proximate an isolation packer inflation port.

Referring now to FIG. 3B, illustrated is a schematic elevational view of the installation of FIG. 3A with the packer setting ports proximate an isolation packer inflation port. Again, it should be recognized that setting the isolation packers is also known to those who are skilled in the art. With the packer setting assembly 250 movably coupled to the packer assembly 210, the packer setting assembly 250 is withdrawn to locate the packer setting ports 253 proximate the isolation packer inflation port 363. In this position, the plurality of upper and lower packer setting seals 255, 257 contact the bore 365 of the packer assembly 210, inhibiting fluid flow between the seals 255, 257 and the bore 365. The zone isolation packer 212 has an inflation port 363 communicated with a lower end of a setting piston 364 that moves upward, shearing pin 366, longitudinally compressing and thus radially expanding the sealing element 213. Once expanded, the sealing elements 213 are held in compression by internal slips 367. Similarly, the packer setting tool 250 is run into the well 100, sequentially aligning with and setting the remaining isolation packer 214 and sump packer 216. The packer setting assembly 250 is then withdrawn, leaving the packer assembly 210 installed in the well 100.

Figure 4:
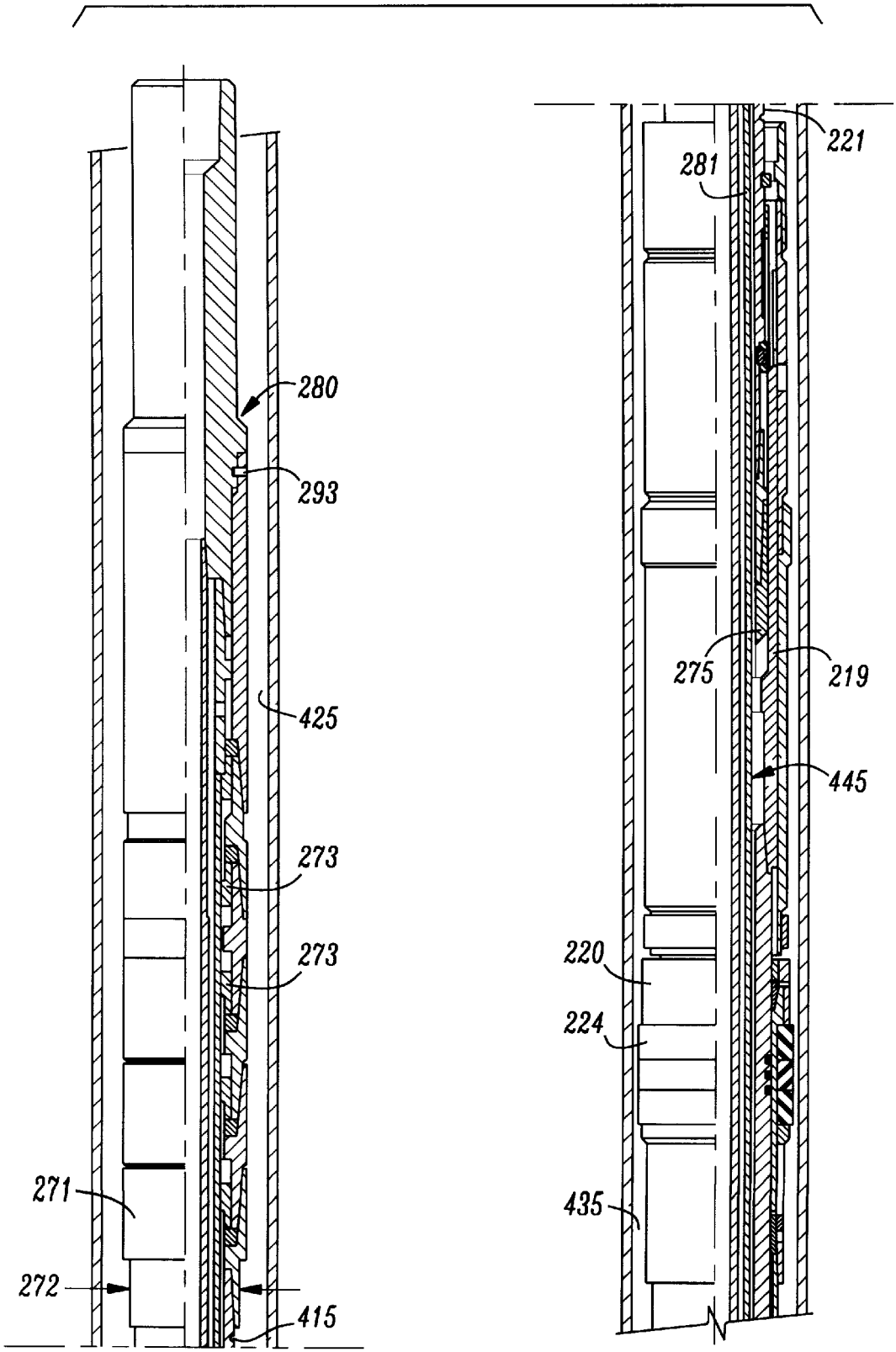
FIG. 4 illustrates a schematic elevational view of the well and packer assembly of FIG. 3A with the gravel packing assembly of FIG. 2C run into the well.

Referring now to FIG. 4, illustrated is a partial schematic elevational view of the well and packer assembly of FIG. 3A with the gravel packing assembly of FIG. 2C run into the well. The gravel packing assembly 270 is run into the well 100 so that the pack-off conduit 271 contacts and latches the uphole end of the primary packer assembly 220 by means of the latch mechanism 275. In a preferred embodiment, the latch mechanism 275 is a threaded collet 275, removably engaging the attachment collar 219. As can be seen in the illustration, the pack-off conduit 271 is of such a diameter 272 that it is prevented from passing through the bore 221 of the primary packer 220. Once the pack-off conduit 271 has latched to the primary packer 220 the work string is picked up and a shear pin 293 is sheared, movably separating the tool 280 from the pack-off assembly 271. Now, as the tool 280 is raised or lowered through the pack off conduit 271, a smooth outer surface 415 of the outer wash pipe 281 cooperates with seal 273 to inhibit fluid from flowing between an upper well annulus 425 and a lower well cavity 435. The seal 273 inhibits fluid flow between the tool 280 and the seal 273 uphole from the primary packing seal 224.

Figure 5A:
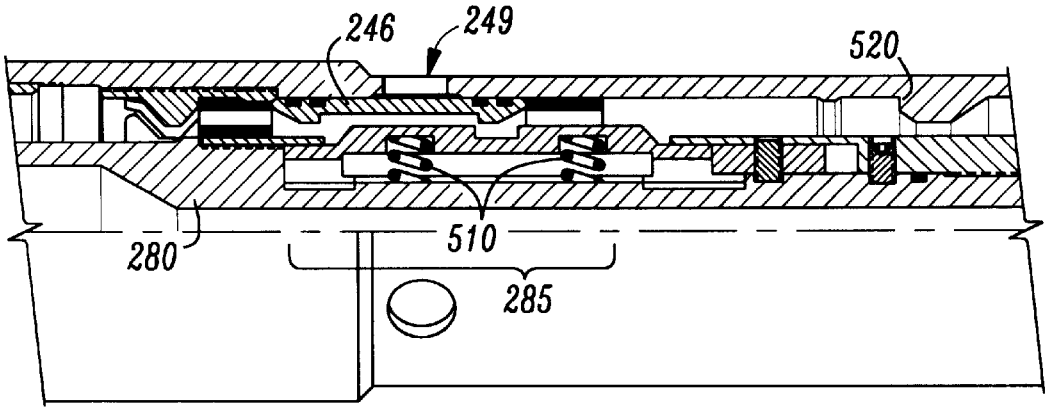
FIG. 5A illustrates a shifting profile on the lowermost end of the tool of the gravel packing assembly engaged with a closing sleeve valve in the closed position.
Figure 5B:
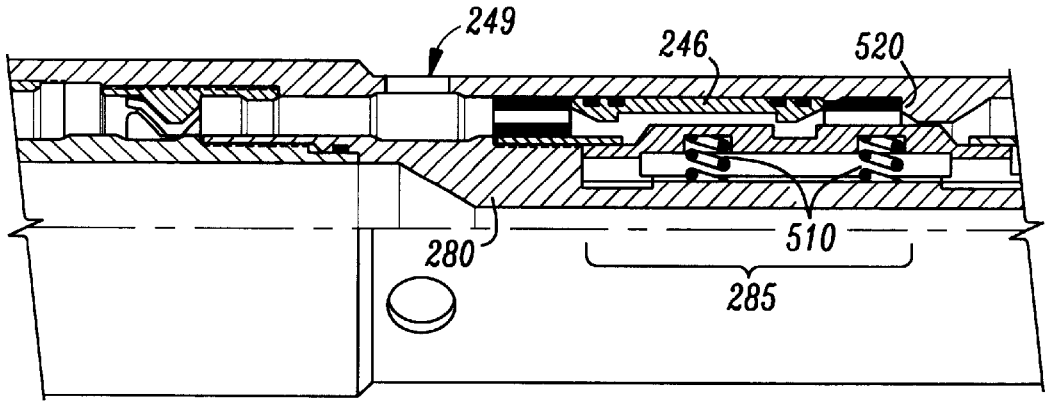
FIG. 5B illustrates the closing sleeve valve of FIG. 5A in the open position.

Referring now to FIG. 5A, illustrated is a shifting profile on the lowermost end of the tool of the gravel packing assembly engaged with a closing sleeve valve in the closed position. When the packer assembly 210 is installed in the well 100 as in FIG. 3A, the closing sleeve valves 239, 249 are in the closed position. Once pin 293 is sheared and the tool 280 is free to move through the packer 220 and the packoff conduit 271, the tool 280 is run into the well 100 so that shifting profile 285 contacts the closing sleeve 246 on the downward stroke. Springs 510 compress during the downward stroke and the shifting profile 285 on the lowermost end of the tool 280 of the gravel packing assembly 270 engages with the closing sleeve 246. Once engaged, the tool 280 is run further into the well 100 sufficient to cause the closing sleeve 246 to slide to the open position as shown in FIG. 5B. When the closing sleeve 246 encounters shoulder 520 on the downward stroke of the tool 280, the closing sleeve 246 stops, springs 510 compress, and the shifting profile 285 disengages from the closing sleeve 246. The valve 249 is thus left in the open position.

Figure 6:
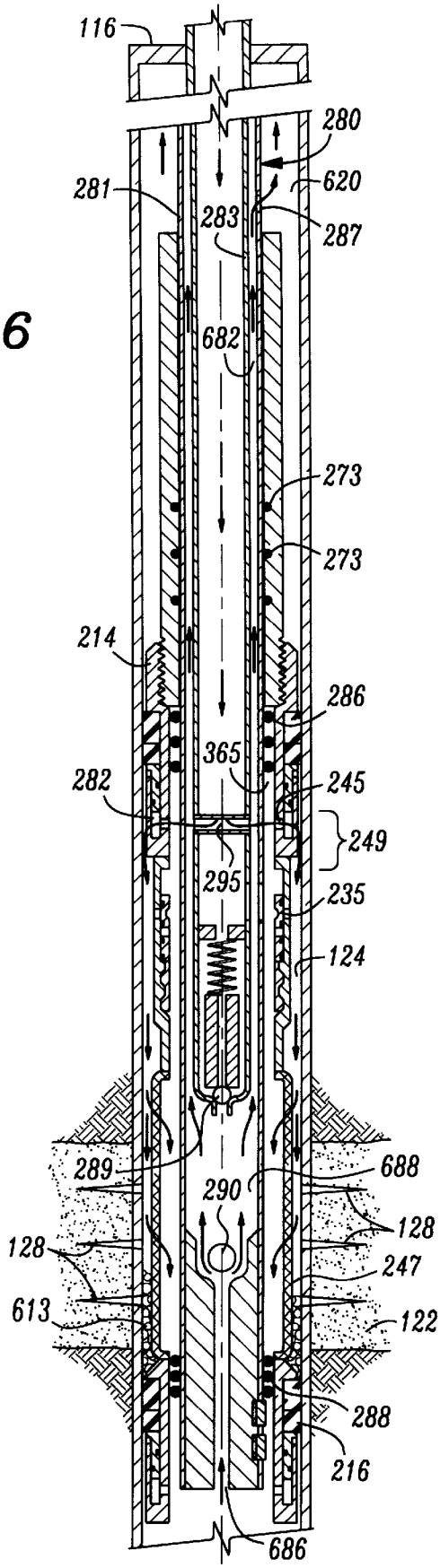
FIG. 6 illustrates the gravel packing assembly of FIG. 2C in position to pack-off the second zone of the well of FIG. 1.

With the closing sleeve valve 249 open, the tool 280 is run further into the well 100 until the gravel pack port 282 of the gravel packing tool 280 is proximate the open circulation port 245 of the packer assembly 210. Referring now to FIG. 6, illustrated is the gravel packing assembly of FIG. 2C in position to pack-off the second zone of the well of FIG. 1. In this location, the upper gravel packing seals 286 and the lower gravel packing seals 288 about the gravel packing tool 280 contact the hone bore 365 of the isolation packers 214, 216. Note also that the seal 273 within the pack-off conduit 271 is inhibiting fluid flow about the outer wash pipe 281. FIG. 6 further illustrates the flow path of a gravel laden slurry into the second production zone of the well of FIG. 1. The gravel laden slurry, also known as proppant, is pumped from the surface location 116 down through the inner wash pipe 283 and around the gravel pack cross over conduit 295, until stopped by the inner wash pipe ball check valve 289. The slurry backs up until it passes out through the gravel pack port 282, then through the open circulation ports 245 of the sleeve valve 249, and into the well annulus 124 adjacent the subsurface production zone 122 that is being gravel-packed.

The gravel from the gravel laden slurry will collect in the well annulus 124 and build up from the sump packer 216 until it reaches an elevation above the upper end of the second production screen 247, at which point an increase in required pumping pressure will be detected at the surface 116, thus indicating that the gravel-packing operation is completed. The gravel will collect as indicated at 613 and the carrier fluid from the gravel laden slurry will pass through the lower production screen 247. The slurry will then flow up through the open lower end of the outer wash pipe 281 and up past the outer wash pipe ball check valve 290 into a lower housing bore 686. The slurry continues through an annular bypass passage 688 through the gravel pack crossover conduit 295, and through a tubing micro annulus 682 between the outer wash pipe 281 and the concentric inner wash pipe 283. Flow continues through the outer wash pipe circulation port 287 above the primary packer 220 and back to the surface location 116 by way of an upper well annulus 620.

After the gravel is completely in place, the gravel pack may be squeezed by closing off the upper well annulus 620 and applying pressure to the bore of the inner wash pipe 283. This will cause gravel to be forced out into the perforations 126 and will consolidate the gravel pack.

Figure 7A:
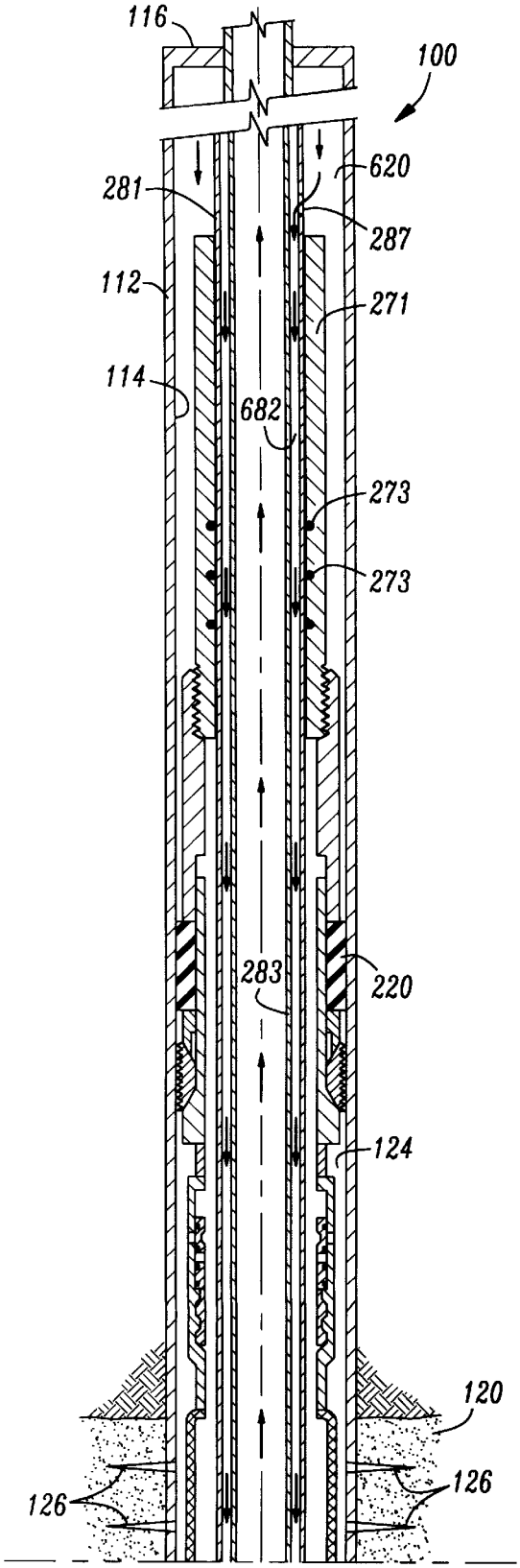
FIGS. 7A and 7B illustrate the gravel packing assembly of FIG. 2C in position to reverse flow the second zone of the well of FIG. 1.
Figure 7B:
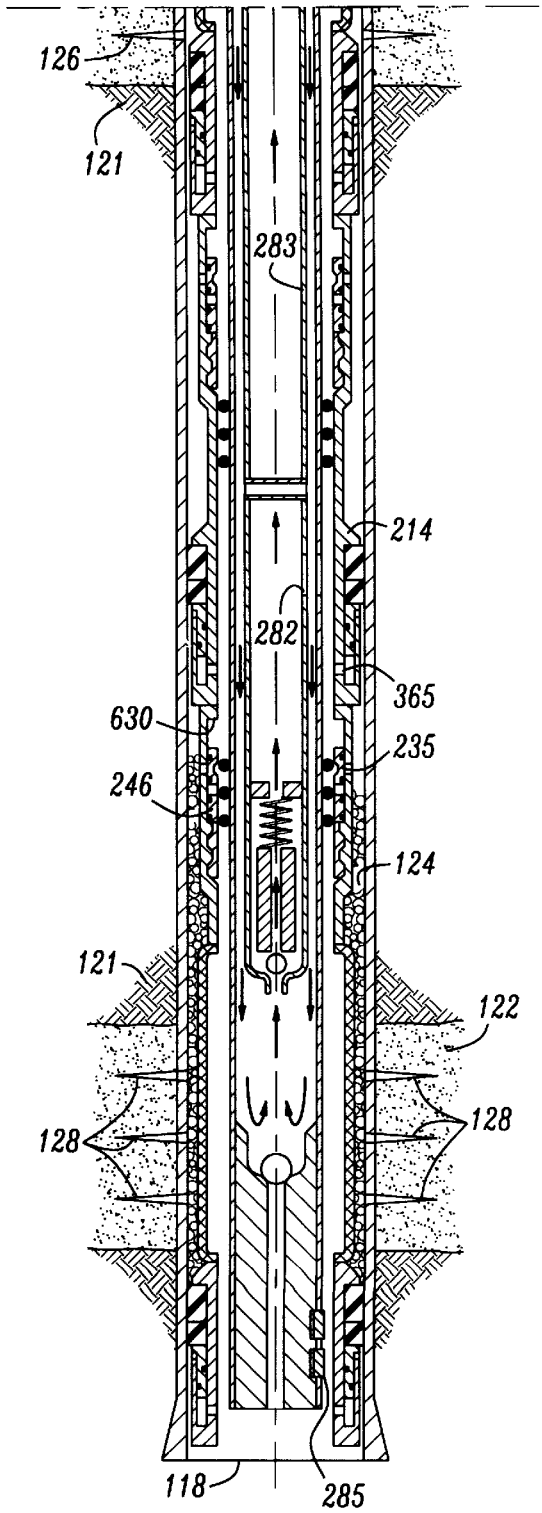

Following the packing procedure, a reversing operation is then conducted. Referring now to FIGS. 7A and 7B, illustrated is the gravel packing assembly of FIG. 2C in position to reverse flow the second zone of the well of FIG. 1. The tool string 280 is picked up until the gravel pack port 282 is isolated in the packer bore 365. This location places the upper gravel pack seals 286 in the hone bore 365 above the second zone upper packer 214, and the lower gravel pack seals 288 are in the lower hone bore 365 above the gravel pack circulation ports 235. A cleanout fluid is then pumped into the upper well annulus 620 to the primary packer 220, through the outer wash pipe upper circulation port 287. During this pumping, the seal 273 within the pack-off conduit 271 continues to inhibit fluid flow from the upper well annulus 620 about the outer wash pipe 281. The fluid continues down the microannulus 682 between the inner and outer wash pipes 283, 281, through the gravel pack cross over conduit 295, and down against the outer wash pipe check valve ball 290. At this point the flow direction reverses upwardly against and past the inner wash pipe ball check valve 289 and around the fluted member 291 then up the inner wash pipe 283 back to the surface 116. This reversing forces any remaining proppant back to the surface 116 where it is recovered.

Following the reversing operation, the tool 280 is pulled up until the shifting profile 285 once again engages with the closing sleeve 246, and returns the closing sleeve 246 to the closed position as shown in FIG. 5A. Further upward force on the tool 280 causes the shifting sleeve 246 to encounter shoulder 630 and the shifting sleeve 246 stops. The shifting profile 285 then disengages from the closing sleeve 246 allowing the tool 280 to be withdrawn to a position to pack the first production zone 120. The procedure for packing the first production zone 120 is analogous to that for the second production zone just described.

Upon completion of the well packing, the threaded collet 275 is released, the entire gravel packing assembly 270 is retrieved from the well 100, and production tubing is attached to the primary packing assembly 220. One skilled in the art will realize that other steps in the completion of the well may be necessary but they are not relevant to the present invention.

From the above, it is apparent that the present invention provides a gravel pack assembly for use in a wellbore having a packer positioned therein with a minimum inside diameter and a primary packing seal. In one embodiment, the gravel pack assembly comprises a pack-off conduit that is coupleable to the packer. The pack-off conduit has a maximum outer diameter that is sufficient to prevent the pack-off conduit from traversing the minimum inside diameter of the packer. The gravel pack assembly further includes a seal positioned about an inside diameter of the pack-off conduit. The seal is engageable with an outer surface of a tool that is passable through the pack-off conduit to inhibit fluid flow between the seal and the tool, uphole from the primary packing seal. The primary packer seal is typically near the uphole end of the packer and is the seal that isolates the downhole zones from the pressure exerted by the fluid uphole from the primary packer seal.

Although the present invention has been described in detail, those who are skilled in the art should understand that they can make various changes, substitutions and alterations herein without departing from the spirit and scope of the invention in its broadest form.

What is claimed is:

1. For use in a wellbore having a packer positioned therein, said packer having a minimum inside diameter and a primary packing seal, a gravel pack assembly comprising:

a pack-off conduit couplable to said packer and having a maximum outer diameter sufficient to prevent said pack-off conduit from traversing said minimum inside diameter; and a seal positioned about an inside diameter of said pack-off conduit and engageable with an outer surface of a tool slidably passable through said pack-off conduit to inhibit fluid flow between said seal and said tool.

2. The gravel pack assembly as recited in claim 1 wherein said pack-off conduit includes a latch mechanism configured to removably latch said gravel pack assembly to an up-hole end of said packer.

3. The gravel pack assembly as recited in claim 2 wherein said latch mechanism is a threaded collet.

4. The gravel pack assembly as recited in claim 1 wherein said seal is an O-ring.

5. The gravel pack assembly as recited in claim 4 wherein said O-ring is a metal ring having rubber thereon.

6. The gravel pack assembly as recited in claim 5 wherein said metal ring is threadedly retained within a groove formed in an interior side wall of said pack-off conduit.

7. The gravel pack assembly as recited in claim 1 further comprising a plurality of seals spatially separated along a length of said pack-off conduit.

8. The gravel pack assembly as recited in claim 1 wherein said tool is a wash pipe assembly removably coupled to said pack-off conduit, said wash pipe assembly having an outer diameter less than an inner diameter of said pack-off conduit such that said wash pipe assembly is passable through said pack-off conduit.

9. The gravel pack assembly as recited in claim 8 wherein said wash pipe assembly is removably coupled to said pack-off conduit by a shear pin.

10. The gravel pack assembly as recited in claim 8 wherein said wash pipe assembly includes an inner wash pipe and an outer wash pipe.

11. The gravel pack assembly as recited in claim 10 wherein said seal is configured to engage an outer surface of said outer wash pipe to inhibit fluid flow between said seal and said outer wash pipe.

12. The gravel pack assembly as recited in claim 10 wherein said outer wash pipe includes an outer wash pipe check ball valve.

13. The gravel pack assembly as recited in claim 10 wherein said inner wash pipe includes an inner wash pipe check ball valve.

14. The gravel pack assembly as recited in claim 10 wherein said inner wash pipe includes a gravel pack cross over conduit.

15. The gravel pack assembly as recited in claim 1 wherein said tool includes a circulation port.

16. The gravel pack assembly as recited in claim 1 wherein said tool further includes a gravel pack port.

17. The gravel pack assembly as recited in claim 1 wherein said tool further includes a plurality of seals coupled to and positioned along a length of said tool and engageable against an interior wall of said packer to inhibit fluid flow between said seals and said interior wall.

18. The gravel pack assembly as recited in claim 1 wherein said tool further includes a shifting profile coupled to said tool and engageable with a closing sleeve movably coupled to said packer.

19. The gravel pack assembly as recited in claim 1 wherein said tool is removably coupled to said pack-off conduit by a shear pin.

20. For use in a wellbore, a zone isolation assembly, comprising:

a packer assembly positionable within said wellbore and having a minimum inside diameter and a primary packing seal;

a pack-off conduit couplable to an uphole end of said packer assembly and having a maximum outer diameter sufficient to prevent said pack-off conduit from traversing said minimum inside diameter of said packer assembly;

a tool slidably passable through said pack-off conduit; and a seal positioned about an inside diameter of said pack-off conduit and engageable with an outer surface of said tool to inhibit fluid flow between said seal and said tool.

21. The zone isolation assembly as recited in claim 20 wherein said pack-off conduit includes a latch mechanism configured to removably latch said gravel pack assembly to said up-hole end of said packer assembly.

22. The zone isolation assembly as recited in claim 21 wherein said latch mechanism is a threaded collet.

23. The zone isolation assembly as recited in claim 20 wherein said seal is an O-ring.

24. The zone isolation assembly as recited in claim 23 wherein said O-ring is a metal ring having rubber thereon.

25. The zone isolation assembly as recited in claim 24 wherein said metal ring is threadedly retained within a groove formed in an interior side wall of said pack-off conduit.

26. The zone isolation assembly as recited in claim 20 further comprising a plurality of seals spatially separated along a length of said pack-off conduit.

27. The zone isolation assembly as recited in claim 20 further comprising a wash pipe assembly removably coupled to said pack-off conduit, said wash pipe assembly having an outer diameter less than an inner diameter of said pack-off conduit such that at least a portion of said wash pipe assembly is passable through said pack-off conduit.

28. The zone isolation assembly as recited in claim 27 wherein said wash pipe assembly is removably coupled to said pack-off conduit by a shear pin.

29. The zone isolation assembly as recited in claim 27 wherein said wash pipe assembly includes an inner wash pipe and an outer wash pipe.

30. The zone isolation assembly as recited in claim 29 wherein said seal is configured to engage an outer surface of said outer wash pipe to inhibit fluid flow between said seal and said outer wash pipe.

31. The zone isolation assembly as recited in claim 29 wherein said outer wash pipe includes an outer wash pipe check ball valve.

32. The zone isolation assembly as recited in claim 29 wherein said inner wash pipe includes an inner wash pipe check ball valve.

33. The zone isolation assembly as recited in claim 29 wherein said inner wash pipe includes a gravel pack cross over conduit.

34. The zone isolation assembly as recited in claim 20 wherein said tool includes a circulation port.

35. The zone isolation assembly as recited in claim 20 wherein said tool further includes a gravel pack port.

36. The zone isolation assembly as recited in claim 20 wherein said tool further includes a plurality of seals positioned along a length of and about said tool and engageable against an interior wall of said packer to inhibit fluid flow between said seals and said interior wall.

37. The zone isolation assembly as recited in claim 20 wherein said tool further includes a shifting profile engageable with a closing sleeve shiftable coupled to said packer assembly.

38. The zone isolation assembly as recited in claim 20 wherein said tool is removably coupled to said pack-off conduit by a shear pin.

39. The zone isolation assembly as recited in claim 20 wherein said packer assembly includes a primary packer seal adjacent an uphole end of said packer assembly.

40. The zone isolation assembly as recited in claim 36 wherein said packer assembly includes an isolation packer seal downhole from said primary packer seal.

41. The zone isolation assembly as recited in claim 40 wherein said packer assembly includes a plurality of spatially separated isolation packer seals downhole from said primary packer seal.

42. The zone isolation assembly as recited in claim 20 wherein said packer assembly includes a circulation port.

43. The zone isolation assembly as recited in claim 42 wherein said packer assembly further includes a closing sleeve coupled to said packer assembly adjacent said circulation port, said closing sleeve movable with respect to said circulation port between an open position and a closed position.

44. The zone isolation assembly as recited in claim 42 wherein said packer assembly includes a plurality of circulation ports, each of said circulation ports having a closing sleeve adjacent each of said circulation ports, each of said closing sleeves movable with respect to said circulation ports between an open position and a closed position.

45. The zone isolation assembly as recited in claim 20 wherein said packer assembly includes a gravel pack screen coupled to and downhole from said packer assembly.

46. The zone isolation assembly as recited in claim 45 wherein said packer assembly includes a plurality of spatially separated gravel pack screens coupled to and downhole from said packer assembly.

47. The zone isolation assembly as recited in claim 20 wherein said minimum diameter of said packer assembly is five inches or less.

48. For use in a wellbore, a well completion system, comprising:

a packer assembly positionable within said wellbore and having a minimum inside diameter and a primary packing seal;

a packer setting assembly removably couplable to said packer assembly;

a pack-off conduit couplable to an uphole end of said packer assembly and having a maximum outer diameter sufficient to prevent said pack-off conduit from traversing said minimum inside diameter of said packer assembly;

a tool slidably passable through said pack-off conduit; and a seal positioned about an inside diameter of said pack-off conduit and engageable with an outer surface of said tool to inhibit fluid flow between said seal and said tool.

49. The well completion system as recited in claim 48 wherein said pack-off conduit includes a latch mechanism configured to removably latch said gravel pack assembly to said up-hole end of said packer assembly.

50. The well completion system as recited in claim 49 wherein said latch mechanism is a threaded collet.

51. The well completion system as recited in claim 48 wherein said seal is an O-ring.

52. The well completion system as recited in claim 51 wherein said O-ring is a metal ring having rubber thereon.

53. The well completion system as recited in claim 52 wherein said metal ring is threadedly retained within a groove formed in an interior side wall of said pack-off conduit.

54. The well completion system as recited in claim 48 further comprising a plurality of seals spatially separated along a length of said pack-off conduit.

55. The well completion system as recited in claim 48 further comprising a wash pipe assembly removably coupled to said pack-off conduit, said wash pipe assembly having an outer diameter less than an inner diameter of said pack-off conduit such that said wash pipe assembly is passable through said pack-off conduit.

56. The well completion system as recited in claim 55 wherein said wash pipe assembly is removably coupled to said pack-off conduit by a shear pin.

57. The well completion system as recited in claim 55 wherein said wash pipe assembly includes an inner wash pipe and an outer wash pipe.

58. The well completion system as recited in claim 57 wherein said seal is configured to engage an outer surface of said outer wash pipe to inhibit a fluid flow between said seal and said outer wash pipe.

59. The well completion system as recited in claim 57 wherein said outer wash pipe includes an outer wash pipe check ball valve.

60. The well completion system as recited in claim 57 wherein said inner wash pipe includes an inner wash pipe check ball valve.

61. The well completion system as recited in claim 57 wherein said inner wash pipe includes a gravel pack cross over conduit.

62. The well completion system as recited in claim 48 wherein said tool includes a circulation port.

63. The well completion system as recited in claim 48 wherein said tool further includes a gravel pack port.

64. The well completion system as recited in claim 48 wherein said tool further includes a plurality of seals coupled to and positioned along a length of and about said tool and engageable against an interior wall of said packer assembly to inhibit fluid flow between said seals and said interior wall.

65. The well completion system as recited in claim 48 wherein said tool further includes a shifting profile coupled to said tool and engageable with a closing sleeve movably coupled to said packer assembly.

66. The well completion system as recited in claim 48 wherein said tool is removably coupled to said pack-off conduit by a shear pin.

67. The well completion system as recited in claim 48 wherein said packer assembly includes a primary packer seal adjacent an uphole end of said packer assembly.

68. The well completion system as recited in claim 48 wherein said packer assembly includes an isolation packer seal downhole from said primary packer seal.

69. The well completion system as recited in claim 68 wherein said packer assembly includes a plurality of spatially separated isolation packer seals downhole from said primary packer seal.

70. The well completion system as recited in claim 48 wherein said packer assembly includes a circulation port.

71. The well completion system as recited in claim 70 wherein said packer assembly further includes a closing sleeve adjacent said circulation port, said closing sleeve movable with respect to said circulation port between an open position and a closed position.

72. The well completion system as recited in claim 70 wherein said packer assembly includes a plurality of circulation ports, each of said circulation ports having a closing sleeves adjacent each of said circulation ports, each of said closing sleeves movable with respect to said circulation ports between an open position and a closed position.

73. The well completion system as recited in claim 48 wherein said packer assembly includes a gravel pack screen coupled to and downhole from said packer assembly.

74. The well completion system as recited in claim 73 wherein said packer assembly includes a plurality of spatially separated gravel pack screens coupled to and downhole from said packer assembly.

75. The well completion system as recited in claim 48 wherein said minimum diameter of said packer assembly is five inches or less.

* * * * *